US010543886B2

(12) United States Patent
Van Miert

(10) Patent No.: US 10,543,886 B2
(45) Date of Patent: Jan. 28, 2020

(54) MARINE VESSEL PERFORMANCE DIAGNOSTICS

(71) Applicant: WÄRTSILÄ FINLAND OY, Vaasa (FI)

(72) Inventor: Ronald Van Miert, Drunen (NL)

(73) Assignee: WÄRTSILÄ FINLAND OY, Vaasa (FI)

( * ) Notice: Subject to any disclaimer, the term of this patent is extended or adjusted under 35 U.S.C. 154(b) by 0 days.

(21) Appl. No.: 15/779,322

(22) PCT Filed: Nov. 26, 2015

(86) PCT No.: PCT/FI2015/050825

§ 371 (c)(1),
(2) Date: May 25, 2018

(87) PCT Pub. No.: WO2017/089643

PCT Pub. Date: Jun. 1, 2017

(65) Prior Publication Data

US 2018/0304969 A1 Oct. 25, 2018

(51) Int. Cl.
*B63B 9/00* (2006.01)
*B63J 99/00* (2009.01)

(52) U.S. Cl.
CPC ..... *B63B 9/001* (2013.01); *B63J 99/00* (2013.01); *B63J 2099/006* (2013.01)

(58) Field of Classification Search
CPC ..... B63B 9/001; B63J 99/00; B63J 2099/006; B63J 2099/008; B63H 1/28
See application file for complete search history.

(56) References Cited

U.S. PATENT DOCUMENTS 6,973,890 B1 * 12/2005 Staerzl ..... B63B 59/04 114/222

FOREIGN PATENT DOCUMENTS

WO WO 2006/123367 A1 11/2006
WO WO 2006/136157 A1 12/2006
WO WO 2010/031399 A1 3/2010

OTHER PUBLICATIONS

International Search Report (PCT/ISA/210) dated Aug. 23, 2016, by the European Patent Office as the International Searching Authority for International Application No. PCT/FI2015/050825.
Written Opinion (PCT/ISA/237) dated Aug. 23, 2016, by the European Patent Office as the International Searching Authority for International Application No. PCT/FI2015/050825.
(Continued)

*Primary Examiner* — Yuen Wong
(74) *Attorney, Agent, or Firm* — Buchanan Ingersoll & Rooney PC

(57) ABSTRACT

An exemplary method for a marine vessel having a propeller mounted to a rotatable shaft for converting rotative shaft power transferred from the shaft to the propeller into thrust to propel the marine vessel across water, includes obtaining measurement values that are descriptive of the shaft power, the thrust and speed through water of the marine vessel; separately estimating at least one of first excess shaft power caused by fouling of the propeller and second excess shaft power caused by fouling of the hull of the marine vessel; and issuing an indication of propeller cleaning in dependence of the first excess shaft power and hull cleaning in dependence of the second excess shaft power.

19 Claims, 4 Drawing Sheets

(56) References Cited

OTHER PUBLICATIONS

Carlton, John, "Chapter 24: Service Performance and Analysis", Marine Propellers and Propulsion, Edition, 25 pages, Nov. 30, 2012. XP055295437.

Notification of Transmittal of the International Preliminary Report on Patentability (Form PCT/IPEA/416) and International Preliminary Report on Patentability (Form PCT/IPEA/409) dated Oct. 31, 2017, by the European Patent Office for International Application No. PCT/FI2015/050825.

International Search Report (PCT/ISA/210) dated Jul. 28, 2016, by the European Patent Office as the International Searching Authority for International Application No. PCT/FI2015/050826.

Written Opinion (PCT/ISA/237) dated Jul. 28, 2016, by the European Patent Office as the International Searching Authority for International Application No. PCT/FI2015/050826.

* cited by examiner

MARINE VESSEL PERFORMANCE DIAGNOSTICS

TECHNICAL FIELD

The present invention relates to a diagnostics arrangement for evaluating operational efficiency of a marine vessel.

BACKGROUND

In marine vessels, a dominant approach for generating thrust to move the vessel across the water involves usage of marine propulsion. At a very high level, a marine propulsion system includes a propeller attached to a rotatable shaft, whereas one or more engines in the vessel are arranged to rotate the shaft, thereby providing the thrust needed for moving the vessel. Characteristics of these (and other) components of a marine propulsion system are designed such that a desired or required amount of thrust and desired operational efficiency is provided e.g. in view of the hull design of the vessel and size of the vessel. In some scenarios, in order to reach desired/required amount of thrust and/or operational efficiency, a vessel may be provided with a plurality of marine propulsion systems like the one outlined above.

In use, some parts of the marine vessel are immersed in water for prolonged periods of time, which gradually lead to fouling of some underwater components of the vessel. Especially fouling of lower parts of the hull of the marine vessel and the propeller e.g. due to marine growth may result in a significant degradation of the vessel performance. As a consequence of the fouling, the thrust generated by the propulsion system at a certain engine output power may be significantly reduced and/or the engine(s) may need to be driven to provide a higher-than-designed output power in order to generate the desired/required amount of thrust. These factors contribute to increased fuel consumption, to prolonged journey time to a destination or both, potentially leading to undesired economic effects in one way or another.

While periodic cleaning of the underwater parts of a marine vessel is a straightforward solution for addressing such causes of degraded marine vessel performance, a cleaning procedure is typically both time-consuming and involves an additional cost, and therefore it is highly desirable to ensure that the cleaning of the underwater parts of the marine vessel is undertaken only when strictly required. In this regard, various techniques for estimating the effect of a performance loss due to fouling of the underwater parts of a marine vessel have been proposed. However, there is a continuous need for improved and more accurate performance estimation techniques to ensure that cleaning and maintenance of the underwater parts of the vessel are undertaken only when improvement in vessel performance after the cleaning/maintenance can be assumed to outweigh the downtime and cost incurred due to the cleaning and maintenance operations.

SUMMARY

Therefore, it is an object of the present invention to provide a technique for estimating operational efficiency of a marine vessel in a reliable and accurate manner.

The object(s) of the invention are reached by an apparatus, by a method and by a computer program as defined by the respective independent claims.

According to an example embodiment, a diagnostics system for estimating operational efficiency of a marine vessel that employs a propulsion system including a propeller mounted to a rotatable shaft for converting rotative shaft power transferred from the shaft to the propeller into thrust to propel the marine vessel across water is provided. The diagnostics system comprises a data acquisition means for obtaining measurement values from a plurality of sensors that are arranged to measure a respective characteristic of the marine vessel operation, comprising measurement values descriptive of the shaft power, the thrust and speed through water of the marine vessel, a data analysis means for estimating, on basis of said measurement values, at least one of first excess shaft power caused by fouling of the propeller and second excess shaft power caused by fouling of the hull of the marine vessel, wherein the estimation of the first excess shaft power is carried out separately from the estimation of the second excess shaft power, and an evaluation means for issuing at least one of indication concerning propeller cleaning at least in dependence of the first excess shaft power and indication concerning hull cleaning at least in dependence of the second excess shaft power.

According to another example embodiment, a method for estimating operational efficiency of a marine vessel that employs a propulsion system including a propeller mounted to a rotatable shaft for converting rotative shaft power transferred from the shaft to the propeller into thrust to propel the marine vessel across water is provided, the method comprising obtaining measurement values that include at least respective measurement values that are descriptive of the shaft power, the thrust and speed through water of the marine vessel, estimating, on basis of said measurement values, at least one of first excess shaft power caused by fouling of the propeller and second excess shaft power caused by fouling of the hull of the marine vessel, wherein the estimation of the first excess shaft power is carried out separately from the estimation of the second excess shaft power; and issuing at least one of indication concerning propeller cleaning at least in dependence of the first excess shaft power and an indication concerning hull cleaning at least in dependence of the second excess shaft power.

According to another example embodiment, a computer program is provided, the computer program including one or more sequences of one or more instructions which, when executed by one or more processors, cause an apparatus to at least perform the method according to the example embodiment described in the foregoing.

The computer program referred to above may be embodied on a volatile or a non-volatile computer-readable record medium, for example as a computer program product comprising at least one computer readable non-transitory medium having program code stored thereon, the program which when executed by an apparatus cause the apparatus at least to perform the method according to the example embodiment described in the foregoing.

The exemplifying embodiments of the invention presented in this patent application are not to be interpreted to pose limitations to the applicability of the appended claims. The verb "to comprise" and its derivatives are used in this patent application as an open limitation that does not exclude the existence of also unrecited features. The features described hereinafter are mutually freely combinable unless explicitly stated otherwise.

Some features of the invention are set forth in the appended claims. Aspects of the invention, however, both as to its construction and its method of operation, together with additional objects and advantages thereof, will be best understood from the following description of some example embodiments when read in connection with the accompanying drawings.

BRIEF DESCRIPTION OF FIGURES

The embodiments of the invention are illustrated by way of example, and not by way of limitation, in the figures of the accompanying drawings, where FIG. 1 schematically illustrates some components of a propulsion train of a marine vessel.

DESCRIPTION OF SOME EMBODIMENTS

Figure 1:
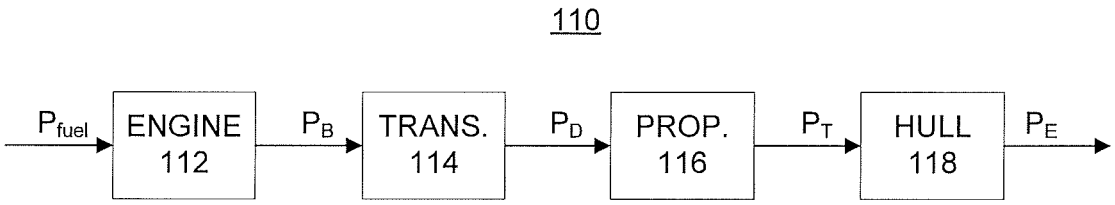

While fouling of several underwater components of a marine vessel may have their own effect to performance degradation of the marine vessel, in various embodiments of the present invention fouling of the hull of the vessel (i.e. hull fouling) and fouling of a propeller in the propulsion system of the vessel (i.e. propeller fouling) are considered. In some examples, the estimation of the vessel performance may rely exclusively in the estimated hull fouling and propeller fouling, whereas in other examples fouling of one or more other components of the vessel are also considered in the estimation.

In consideration of hull fouling, the surface texture or hull roughness of a marine vessel is a continuously changing parameter which has an important effect on the vessel performance. The effect of hull roughness can be considered as an addition to the frictional component of resistance of the hull. The frictional component plays a large role for almost all types of marine vessels.

The roughness of a hull can be considered to be the sum of two separate components, namely permanent roughness and temporary roughness. Permanent roughness may derive e.g. from the initial condition of the hull plates and the condition of the paint on the surface of the hull plates, whereas temporary roughness derives from marine growth over time. Due to its origin, temporary roughness may also be referred to as marine fouling. Temporary roughness can be removed or reduced by the removal of the fouling organisms or by a subsequent coating treatment. While permanent roughness can be responsible for an annual increment of approximately 30 to 60 μm (micrometers) in roughness, the effects of temporary fouling due to marine growth can be considerably more dramatic and can be responsible for even up to 30-40% increase in fuel consumption in a relatively short time.

The sequence of marine fouling commences with slime, comprising bacteria and diatoms, which then progresses to algae and eventually to animal foulers such as barnacles. These life cycles and the adaptability of the various organisms combine to produce a particularly difficult control problem. There are no areas of warm ocean where vessels can be considered immune from attack. The fouling of underwater surfaces is found to be dependent on a variety of parameters such as vessel type, vessel speed, trading pattern, fouling pattern, dry-dock interval of the vessel, permanent roughness of the hull, etc.

Paint systems have developed from traditional anti-fouling coating to self-polishing anti-fouling (SPA) and reactivatable anti-foulings (RA) in order to provide greater protection against hull fouling problems. SPAs are based on components which dissolve slowly in sea water and due to the friction of the sea water passing over the hull, toxins are continuously released. RAs depend on a mechanical polishing with special brushes in order to remove the inactive layer formed at the surface of the anti-fouling. Although particularly successful in minimizing the hull resistance over a docking cycle, hull coatings containing toxins have been the subject of a progressive banning regime by the International Mari-time Organization (IMO). A number of coating solutions are being evolved for use in the post biocide era with various benefits claimed.

In consideration of propeller fouling, propeller roughness can be considered as a complementary problem to that of hull roughness and one which is no less important. As in the hull roughness case, propeller roughness arises from a variety of causes, chief of which are marine growth, impingement attack, corrosion, cavitation erosion, poor maintenance and damage due to contact with foreign objects.

The marine growth found on propellers is similar to that observed on hulls (and described in the foregoing) except that the longer weed strands tend to get torn off of the propeller due to its normal operation. Marine fouling increases the power absorption of the propeller considerably. Fouling is less likely to attach to the surface of the propeller than that of the hull or other underwater parts of the vessel, due to the difference in local velocity.

FIG. 1 illustrates a block diagram of some components of a propulsion train 110 of a marine vessel. The propulsion train 110 represents conversion of the chemical power of the fuel used to power an engine 112 of the vessel into mechanical work done that propels the marine vessel through water. The propulsion train 110 assumes an arrangement where thrust power is obtained from a propulsion system including the engine 112, transmission system 114, a shaft and a propeller 116. Power is transmitted from the engine 112 via the transmission system 114 to rotate the shaft. The propeller 116 is mounted at the external end of the shaft, and the propeller 116 hence converts the rotative power transferred to the shaft from the engine 112 via the transmission system 114 into the thrust power. The thrust power obtained from the propeller 116 is partly consumed due to roughness of the hull 118 of the marine vessel. To model some major aspects of this operation, the propulsion train 110 is depicted as a block diagram including blocks that corresponds to respective power loss component occurring in the engine 112, in the transmission 114, in the propeller 116 and in the hull 118. In this regard, the propulsion train 110 is further depicted with the following variables that represent the power as transferred through the propulsion train:

- $P_{fuel}$ Chemical power carried in the fuel
- $P_B$ Power transferred from the engine 112 to the transmission 114
- $P_D$ Power transmitted from the transmission 114 to the shaft (i.e. shaft power)
- $P_T$ Thrust power obtained from the propeller 116
- $P_E$ Adjusted thrust power in consideration of roughness of the hull 118

In consideration of the effects of marine fouling, the power loss due to effect of the propeller 116 operation and due to effect of roughness of the hull 118 may be considered as the most prominent factors. Therefore, in the following some examples of estimating the need for cleaning and/or maintenance operations concerning the propeller 116, the hull 118 are provided. In particular, in the following examples, the propeller fouling and hull fouling are considered separately from each other, thereby enabling separately detecting the condition where only the propeller 116 requires cleaning/maintenance, where only the hull 118 requires cleaning/maintenance or where both the propeller 116 and hull 118 require cleaning/maintenance. One advantage of such distinction is that e.g. cleaning/maintenance of the propeller 116 likely requires significantly shorter downtime for the marine vessel than any operation that involves cleaning/maintenance of the hull 118—thereby enabling more timely reaction to any performance degradation spawning predominantly from the propeller fouling.

Figure 2:
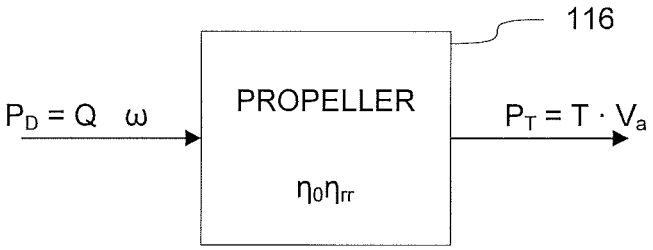
FIG. 2 schematically illustrates an aspect of the propulsion train with some additional detail.

FIG. 2 schematically illustrates an aspect of the propulsion train 110 with some additional detail. In particular, FIG. 2 depicts a part of the power transfer model that may be applied in evaluating efficiency of the propeller operation and used as basis for detecting a propeller fouling condition. Herein, the shaft power $P_D$ (in Watts) transmitted from the shaft to the propeller 116 is derived by $$P_D=Q\cdot\omega, \tag{1}$$

where Q denotes the torque of the shaft (in Newtonmeters) and ω denotes the rotational speed of the shaft (in rotations per minute), and the thrust power $P_T$ (in Watts) obtained from the propeller 116 is derived by $$P_T=T\cdot V_a, \tag{2}$$

where T denotes the thrust (in Newtons) generated by the propeller 116 and $V_a$ denotes average advance velocity of water through the propeller 116 (in meters per second).

Further referring to FIG. 2, the symbols $\eta_0$ and $\eta_{rr}$ in the block representing the propeller 116 denote, respectively, open water efficiency of the propeller 116 and relative rotative efficiency of the propeller. For editorial clarity, in the following we use the symbol $\eta_p=\eta_0\cdot\eta_{rr}$ to denote propeller efficiency. Theoretically, the propeller efficiency is a positive real-valued number in the range from 0 to 1. The propeller efficiency $\eta_p$ is partly determined by the design of the propeller 116 and partly by the fouling of the propeller 116. As a general rule, it is assumed that if the propeller fouling increases, the propeller efficiency $\eta_p$ decreases. As another general rule, it is assumed that if the hull fouling increases, the thrust T required from the propeller 116 increases in order to enable sailing at the same or substantially the same advance speed. Herein, the term advance speed $V_a$ denotes the speed at which water flows into the propeller 116. This relates, via the wake fraction $w_T$, to the speed at which the marine vessel moves through water $V_s$. This relationship is given by the following equation:

$$V_a=(1-w_T)\cdot V_s. \tag{3}$$

Since the change in the wake fraction $w_T$ due to fouling can be assumed to very small, which is also confirmed by the ISO equations concerning the change in the wake fraction $w_T$ due to fouling, a constant advance speed $V_a$ is assumed be equal to a constant speed through water $V_s$.

Consequently, based on the equations (1) and (2), the portion of the shaft power $P_D$ used for propelling the vessel may be denoted as $$P_T=\eta_p\cdot P_D. \tag{4}$$

Hence, higher the propeller efficiency $\eta_p$, the bigger is the portion of the shaft power $P_D$ that is actually converted into thrust power $P_T$ for propelling the vessel. The remaining portion of the shaft power $P_D$ may be considered as 'lost' power $P_{loss}$, which may be computed as $$P_{loss}=P_D-P_T=(1-\eta_p)\cdot P_D. \tag{5}$$

In view of the foregoing, the following, we may state the following

- If only the hull fouling increases, the propeller efficiency $\eta_p$ stays the same. In order to enable the same or substantially the same speed through water $V_s$ when only the hull fouling increases, the thrust power $P_T$ required from the propeller 116 and hence also the required shaft power $P_D$ increases.
- If only the propeller fouling increases, the propeller efficiency $\eta_p$ decreases. In order to enable the same or substantially the same speed through water $V_s$ when only the propeller fouling increases, the thrust power $P_T$ required from the propeller 116 stays the same but the shaft power $P_D$ required to generate the required thrust power increases.

Proceeding from the above observations, it can be seen that the shaft power $P_D$ usage at time t may be expressed as a function of the thrust T obtained from the propeller 116, the propeller efficiency $\eta_p$ and a wake fraction of the vessel $w_T$:

$$P_D(T(t),\eta_p(t),w_T(t)), \tag{6}$$

where T(t) denotes the thrust obtained from the propeller 116 at time t, $\eta_p(t)$ denotes the propeller efficiency at time t, and $w_T(t)$ denotes wake fraction of the vessel at time t. The wake fraction $w_T(t)$ is a factor that indicates "how easily" water flows into the propeller 116.

Further assuming that the time t indicates any random moment of time at which marine fouling concerning either the hull 118, the propeller 116 or both may be occurring, we may further use time $t_s$ to denote a moment of time when each of the hull 118 and the propeller 116 of the vessel are in a respective known condition. Hence, in essence, $t_s$ denotes a predefined reference condition that is not strictly linked to any specific moment of time, but that is herein expressed as a moment of time for notational clarity. Typically, but not necessarily, the reference condition indicates a condition where both the hull 118 and the propeller 116 of the vessel are substantially clean.

With this notation we may further indicate the shaft power $P_D$ usage in case only hull cleaning is applied to the vessel as $$P_D(T(t_s),\eta_p(t),w_T(t_s)), \tag{7}$$

whereas in case only the propeller cleaning is applied to the vessel, the shaft power $P_D$ usage may be denoted as $$P_D(T(t),\eta_p(t_s),w_T(t)). \tag{8}$$

Herein, the hull cleaning refers to cleaning the hull 118 of the vessel into respective reference condition, whereas the propeller cleaning refers to cleaning the propeller 116 into respective reference condition. Assuming that the reference condition denotes substantially clean condition of both the hull 118 and the propeller 116, the hull cleaning refers full cleaning of the hull 118 and the propeller cleaning refers full cleaning of the propeller 116.

Consequently, by using the equations (4), (6) and (8) it is possible to compute or estimate the decrease in the required shaft power $P_D$ usage that would result from cleaning of the propeller 116:

$$P_D(T(t), \eta_p(t), w_T(t)) - P_D(T(t), \eta_p(t_s), w_T(t)) = \frac{1}{\eta_p(t)} P_T(T(t), w_T(t)) - \frac{1}{\eta_p(t_s)} P_T(T(t), w_T(t)) = \left(\frac{1}{\eta_p(t)} - \frac{1}{\eta_p(t_s)}\right) P_T(T(t), w_T(t)) = \left(\frac{P_D(t)}{T(t)V_s(1-w_T(t))} - \frac{P_D(t_s)}{T(t_s)V_s(1-w_T(t_s))}\right) T(t)V_s(1-w_T(t)) = P_D(t) - P_D(t_s)\frac{T(t)}{T(t_s)} \cdot \frac{(1-w_T(t))}{(1-w_T(t_s))}. \quad (9)$$

The last fraction in the equation (9) is, for most practical applications, close to unity and it may be dispensed with while still enabling sufficient accuracy of the estimated decrease in the required shaft power $P_D$ usage. This is further confirmed by investigating the ISO equations concerning the change in wake fraction $w_T$ due to fouling. With this assumption, the equation (9) may be rewritten into $$\Delta P_D(t)_{prop} = P_D(t) - P_D(t_s)\frac{T(t)}{T(t_s)}. \quad (10)$$

As the equation (10) indicates, the decrease in required shaft power usage $\Delta P_D(t)_{prop}$ while keeping the same or substantially the same speed through water $V_s$ (in similar operating conditions) enabled by propeller cleaning may be derived or estimated by multiplying the shaft power $P_D(t_s)$ required for the same speed through water $V_s$ in the reference condition (e.g. one where both the hull 118 and the propeller 116 are substantially clean) by a factor that is defined as the ratio of the thrust T(t) obtained from the propeller 116 at time t and the thrust $T(t_s)$ required for the same speed through water $V_s$ in the reference condition, and subtracting the product so obtained from the shaft power $P_D$ (t) at time t.

Along similar lines, by using the equations (4), (6) and (7) it is possible to compute or estimate the decrease in the required shaft power $P_D$ usage that would result from cleaning of the hull 118:

$$P_D(T(t), \eta_p(t), w_T(t)) - P_D(T(t_s), \eta_p(t), w_T(t_s)) = \frac{1}{\eta_p(t)}(P_T(T(t), w_T(t)) - P_T(T(t_s), w_T(t_s))) = \left(\frac{P_D(t)}{T(t)V_s(1-w_T(t))}\right) T(t)V_s(1-w_T(t)) - T(t_s)V_s(1-w_T(t_s)) = P_D(t)\cdot\left(1 - \frac{T(t_s)}{T(t)} \cdot \frac{(1-w_T(t_s))}{(1-w_T(t))}\right). \quad (11)$$

Using the same reasoning as applied in the foregoing for the equation (9), the last fraction in the equation (11) is, for most practical applications, close to unity and it may be dispensed with while still enabling sufficient accuracy of the estimated decrease in the required shaft power $P_D$ usage. With this assumption, the equation (11) may be rewritten into $$\Delta P_D(t)_{hull} = P_D(t)\cdot\left(1 - \frac{T(t_s)}{T(t)}\right). \quad (12)$$

As the equation (12) indicates, the decrease in required shaft power usage $\Delta P_D(t)_{prop}$ while keeping the same or substantially the same speed through water $V_s$ (in similar operating conditions) enabled by hull cleaning may be derived or estimated by multiplying the shaft power $P_D(t)$ at time t by a factor that is defined by subtracting the ratio of the thrust $T(t_s)$ required for the same speed through water $V_s$ in the reference condition and the thrust T(t) obtained from the propeller 116 at time t from unity.

Figure 3:
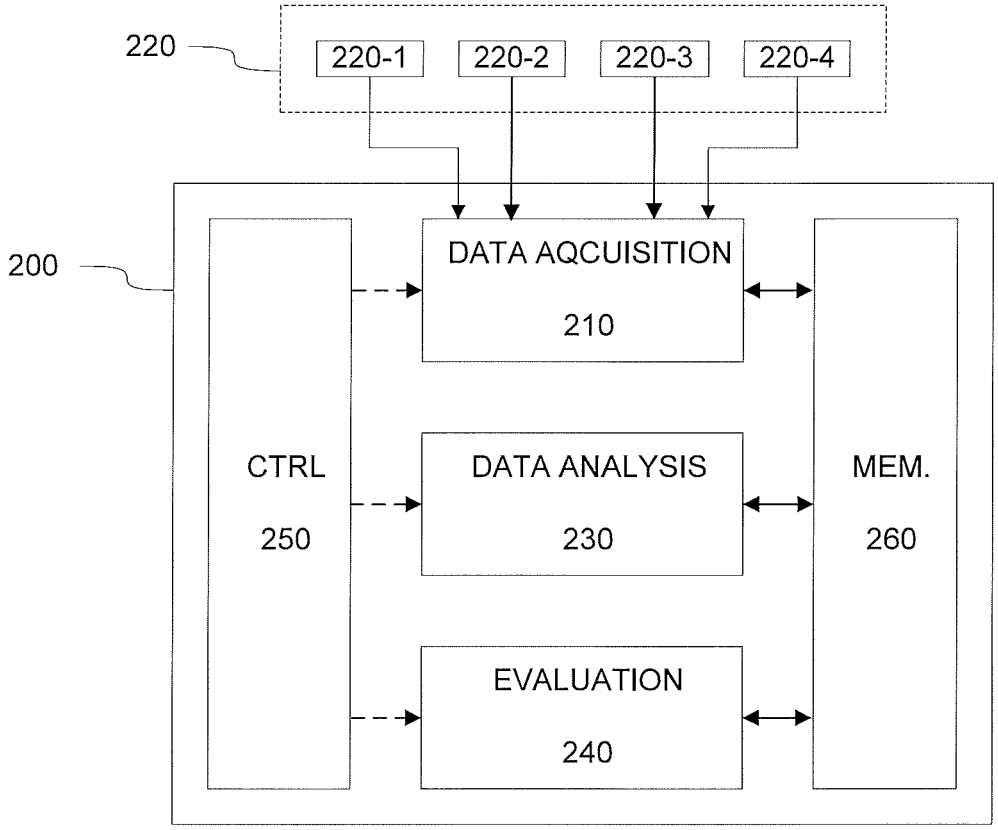
FIG. 3 schematically illustrates some logical components of an exemplifying diagnostics system for estimating operational efficiency of a marine vessel according to an example embodiment.

FIG. 3 schematically illustrates some logical components of an exemplifying diagnostics system 200 for a marine vessel for estimating operational efficiency of the marine vessel. Along the lines described in the foregoing, it is assumed that the marine vessel employs a propulsion system including the engine 112, the transmission system 114, the shaft and a propeller 116, where power is transmitted from the engine 112 via the transmission system 114 to rotate the shaft. The propeller 116 is mounted at the external end of the shaft for converting the rotative shaft power transferred from the shaft to the propeller 116 into thrust to propel the vessel across the water.

In such a propulsion system, the engine 112 may be provided as a diesel engine or as any other engine of suitable type that is able to provide sufficient power to propel the marine vessel. Although referred to in singular, the engine 112 may include an engine system of one or more engines. In an example, the transmission system 114 connecting the engine 112 to the shaft may include just a mechanical mounting arrangement that connects the engine 112 to the shaft (e.g. direct drive). In another example, the transmission system 114 may include a gearbox or a corresponding arrangement that may be applied to transfer the power from the engine 112 to the shaft in a selectable manner and/or adjustable manner. In a further example, the transmission system 114 may, alternatively or additionally, include an electric motor for driving the shaft by using the power transferred thereto from the engine 112 (e.g. a diesel-electric transmission in case a diesel engine is employed).

As an overview, the diagnostics system 200 comprises a data acquisition means 210 for obtaining measurement values from one or more sensors 220, a data analysis means 230 for estimating first excess shaft power $P_{D,p}$ due to propeller fouling on basis of one or more measurement values and for estimating second excess shaft power $P_{D,h}$ due to hull fouling on basis of one or more measurement values such that first excess shaft power $P_{D,p}$ is estimated separately from the second excess shaft power $P_{D,h}$, and an evaluation means 240 for issuing an indication concerning propeller cleaning at least in dependence of the first excess shaft power $P_{D,p}$ and/or for issuing an indication concerning hull cleaning at least in dependence of the second excess shaft power $P_{D,h}$. The diagnostics system 200 further comprises a control means 250 for controlling operation of the data acquisition means 210, the data analysis means 230 and the evaluation means 240. The diagnostics system 200 is further depicted with a memory 260 for storing information.

The sensors 220 comprise a plurality of sensors, each arranged to measure or monitor a respective characteristic of marine vessel operation. In this regard, the sensors 220 comprise at least a thrust sensor 220-1 arranged to measure the thrust T generated by the propeller 116, a torque sensor 220-2 arranged to measure the torque Q in the shaft of the propulsion system, a rotational speed sensor 220-3 arranged to measure rotational speed ω of the shaft of the propulsion system and a speed sensor 220-4 arranged measure the speed through water $V_s$ of the vessel. Each of the sensors **210-*k* may be arranged to continuously provide a respective measurement signal that is descriptive of the current value of a respective measured characteristic. Each of the sensors 220**-*k* may be communicatively coupled to the data acquisition means 210 (and possibly also to one or more other components of the diagnostics system 200) e.g. by a respective dedicated electrical connection. Alternatively, the communicative coupling between the sensors 220 and the data acquisition means 210 (and possibly also to one or more other components of the diagnostics system 200) may be provided by a bus, such as a controller area network (CAN) bus. Each of the thrust sensor 220-1, the torque sensor 220-2, the rotational speed sensor 220-3 and the speed sensor 220-4 may be provided using a suitable sensor device of respective type known in the art.

The data acquisition means 210 may be arranged to obtain respective measurement values from each of the sensors 220-*k*, for example, by periodically reading the respective measurement signal. The reading of a new measurement value from a given one of the sensors 220-*k* may take place at predefined, regular time intervals or according to another predefined schedule. The applied regular time interval (or a schedule of other kind) may be the same for two or more of the sensors 220-*k* or for all sensors 220-*k*, or the applied time interval (or the schedule of other kind) may be defined differently for each of the sensors 220. Alternatively or additionally, the data acquisition means 210 may be arranged to read a new measurement value for one or more of the sensors 220-*k* in response to a command or request received from the control means 250. Regardless of the mechanism employed to control reading of the measurement values, the newly read measurement value is stored in the memory 260 for subsequent use by the data analysis means 230. The measurement values read from each of the thrust sensor 220-1, the torque sensor 220-2, the rotational speed sensor 220-3 and the speed sensor 220-4 are arranged into a respective time series of measurement values in a suitable data structure in the memory 260, thereby not only providing access to the most recent (or instantaneous) measurement value but also to a history of measurement values. Such a data structure may include, for example, a table, a linked list, a database, etc.

In particular, measurement values read from the thrust sensor 210-1 are arranged into a time series of thrust values, denoted as T(t), measurement values read from the torque sensor 220-2 are arranged into a time series of torque values, denoted as Q(t), measurement values read from the rotational speed sensor 220-3 are arranged into a time series of rotational speed values, denoted as ω(t), and measurement values from the speed sensor 220-4 are arranged into a time series of speed through water values, denoted as $V_s(t)$.

The data analysis means 230 may be arranged to carry out estimation of the first excess shaft power $P_{D,p}$. This measure of excess shaft power indicates a decrease in required shaft power $P_D$ that would result from cleaning the propeller 116. The estimation may be carried out using any applicable model of the excess shaft power resulting from propeller fouling, and the estimation may be carried out in response to a command or request in this regard from the control means 250. As an example in this regard, the estimation of the first excess shaft power $P_{D,p}$ may be carried out in dependence of the thrust T generated by the propeller 116 and the shaft power $P_D$ at time $t_p$ in view of the speed through water $V_s$ of the marine vessel at time $t_p$ and further in view of the shaft power and thrust required for the same speed through water $V_s$ in a predefined reference condition of the propeller 116.

The reference condition of the propeller 116 may indicate, for example, a condition where the propeller 116 is cleaned or a condition where the propeller 116 is both cleaned and polished, where the latter example condition may be considered to indicate a state where the propeller 116 is substantially clean. As an example, there may be a single predefined reference condition for the propeller 116, e.g. the one where the propeller 116 is cleaned or the one where the propeller 116 is both cleaned and polished. In another example, there are two or more reference conditions for the propeller 116, e.g. the one where the propeller 116 is cleaned and the one where the propeller 116 is both cleaned and polished. In a further example, there may be one or more (different) reference conditions for the propeller 116, each of which corresponds to a respective degree of propeller cleanness (or, to turn the definition the other way around, a respective degree of propeller fouling), defined e.g. in a range from 0 to 100% propeller cleanness (or propeller fouling).

As a particular example, the estimation of the first excess shaft power $P_{D,p}$ may be carried out on basis of the equation (10), as described in the following in further detail. In this regard, the estimation involves reading, from the memory 260, the thrust value $T(t_p)$, the torque value $Q(t_p)$, the rotational speed value $\omega(t_p)$ and the speed through water value $V_s(t_p)$ for time $t_p$. Time $t_p$ may be specified in the command or request issued by the control means 250. While $t_p$ may indicate any time instant covered by the history measurement values represented by the respective time series stored in the memory 260, typically $t_p$ indicates the current time and hence causes estimation to be carried out on basis of the current or the most recent values of T(t), Q(t), ω(t) and v(t) to reflect the current propeller fouling condition of the vessel.

To enable the estimation of the first excess shaft power $P_{D,p}$, the memory 260 may store a propeller reference database that includes reference values of the shaft power $P_D(t_s)$ and thrust $T(t_s)$ in one or more reference conditions of the propeller 116, including e.g. a reference condition where the propeller 116 is substantially clean (e.g. substantially 100% propeller cleanness or 0% propeller fouling). In particular, to enable reliable and accurate estimation of the first excess shaft power $P_{D,p}$ for the one or more reference conditions of the propeller 116 at a plurality of different speeds through water $V_s$, the propeller reference database stores the reference values of $P_D(t_s)$ and $T(t_s)$ for the one or more reference conditions of the propeller 116 at a plurality of $V_s$ speeds through water $V_s$ of the vessel. The reference values stored in the reference database are pre-stored values that may be obtained based on respective computational models or based on experimental data collected by operating the vessel in the respective reference conditions at various speeds through water $V_s$ of interest. While herein we refer to the reference database, a suitable reference data structure of other type may be employed instead.

Upon commencing the estimation of the first excess shaft power $P_{D,p}$, the data analysis means 230 accesses the propeller reference database in order to find the reference values $P_D(t_s)$ and $T(t_s)$ that correspond to the desired reference condition of the propeller 116 at the speed through water $V_s(t_p)$ of the vessel at time $t_p$. The values of $Q(t_p)$ and $\omega(t_p)$ are employed to derive the shaft power $P_D(t_p)$ at time $t_p$ in accordance with the equation (1) by $$P_D(t_p)=Q(t_p)\cdot\omega(t_p). \tag{13}$$

With this piece of information, the data analysis means 230 may be arranged to compute the first excess shaft power $P_{D,p}$ in accordance with the equation (10) by $$P_{D,p}(t_p) = P_D(t_p) - P_D(t_s)\frac{T(t_p)}{T(t_s)}. \quad (14)$$

The data analysis means 230 may store the estimated first excess shaft power $P_{D,p}(t_p)$ together with an indication of time $t_p$ in the memory 260 for subsequent use and/or it may directly provide at least the estimated first excess shaft power $P_{D,p}(t_p)$ to the evaluation means 240 for further analysis.

In addition to or instead of estimation of the first excess shaft power $P_{D,p}$, the data analysis means 230 may be arranged to carry out estimation of the second excess shaft power $P_{D,h}$. This measure of excess shaft power indicates a decrease in required shaft power $P_D$ that would result from cleaning the hull 118 of the marine vessel. The estimation may be carried out using any applicable model of the excess shaft power resulting from hull fouling, and the estimation may be carried out in response to a command or request in this regard from the control means 250. As an example in this regard, the estimation of the second excess shaft power $P_{D,h}$ may be carried out in dependence of the thrust T generated by the propeller 116 and the shaft power $P_D$ at time $t_h$ in view of the speed through water $V_s$ at time $t_h$ and further in view of the thrust required for the same speed through water $V_s$ in a predefined reference condition of the hull 118 of the marine vessel.

The reference condition of the hull 118 may indicate, for example, a condition of where the hull 118 is fully clean or a condition where the hull 118 is clean to a predefined extent, expressed e.g. as a percentage in the range from 0 to 100%. In an example, there is a single predefined reference condition for the hull 118, e.g. one that reflects fully clean condition of the hull 118 (i.e. 100% clean hull condition) or one that reflects another predefined degree of hull cleanness. In another example, there may be two or more different reference conditions for the hull 118, each of which corresponds to a respective degree of hull cleanness (or, to turn the definition the other way around, a respective degree of hull fouling), defined e.g. in a range from 0 to 100% hull cleanness (or hull fouling).

As a particular example, the estimation of the second excess shaft power $P_{D,h}$, may be carried out on basis of the equation (11), as described in the following in further detail. In this regard, the estimation involves reading, from the memory 260, the thrust value $T(t_h)$, the torque value $Q(t_h)$, the rotational speed value $\omega(t_h)$ and the speed through water value $V_s(t_h)$ for time $t_h$. Time $t_h$ may be specified in the command or request issued by the control means 250. Similar considerations as provided in the foregoing for the time instant $t_p$ equally apply to the time instant $t_h$ as well. In an example, time $t_h$ is the same or substantially the same as time $t_p$ applied for evaluation of the first excess shaft power $P_{D,p}$ to enable direct comparison between the first and second excess shaft powers $P_{D,p}$ and $P_{D,h}$. However, since the first and second excess shaft powers $P_{D,p}$ and $P_{D,h}$ can be evaluated separately and independently of each other, it is not necessary to apply $t_h$ that equals $t_p$ but either of the first and second excess shaft powers $P_{D,p}$ and $P_{D,h}$ may be evaluated as desired or required.

To enable the estimation of the second excess shaft power $P_{D,h}$, the memory 260 may store a propeller reference database that includes reference values of the shaft power $P_D(t_s)$ and thrust $T(t_s)$ in one or more reference conditions of the hull 118, including e.g. a reference condition where the hull 118 is substantially clean (e.g. substantially 100% hull cleanness or 0% hull fouling). In particular, to enable reliable and accurate estimation of the second excess shaft power $P_{D,h}$ for the one or more reference conditions of the hull 118 at a plurality of different speeds through water $V_s$, the hull reference database stores the reference values of $P_D(t_s)$ and $T(t_s)$ for the one or more reference conditions of the hull 118 at a plurality of speeds through water $V_s$ of the vessel. The reference values stored in the hull reference database are pre-stored values that may be obtained based on respective computational models or based on experimental data collected by operating the vessel in the respective reference conditions at various speeds through water $V_s$ of interest. The hull reference database may be provided jointly with the propeller reference database or it may be provided as an entity separate from the propeller reference database.

Upon commencing the estimation of the second excess shaft power $P_{D,h}$, the data analysis means 230 accesses the hull reference database in order to find the reference values $P_D(t_s)$ and $T(t_s)$ that correspond to the $V_s$ speed through water $V_s(t_h)$ of the vessel at the desired time instant $t_h$. The values of $Q(t_h)$ and $\omega(t_h)$ are employed to derive the shaft power $P_D(t_h)$ at the desired time instant $t_p$ in accordance with the equation (1) by $$P_D(t_h)=Q(t_h)\cdot\omega(t_h). \quad (15)$$

With this piece of information, the data analysis means 230 may be arranged to compute the second excess shaft power $P_{D,h}$ in accordance with the equation (12) by $$P_{D,h}(t_h) = P_D(t_h)\cdot\left(1 - \frac{T(t_s)}{T(t_h)}\right). \quad (16)$$

The data analysis means 230 may store the estimated second excess shaft power $P_{D,h}(t_h)$ together with an indication of time $t_h$ in the memory 260 for subsequent use and/or it may directly provide at least the estimated second excess shaft power $P_{D,h}(t_h)$ to the evaluation means 240 for further analysis.

Since the estimation procedures for the first excess shaft power $P_{D,p}$ and the second excess shaft power $P_{D,h}$ are separate and independent of each other, the data analysis means 230 may be arranged to enable estimation of one or both of the first excess shaft power $P_{D,p}$ and the second excess shaft power $P_{D,h}$. Moreover, in case the data analysis means 230 enables estimation of both the first excess shaft power $P_{D,p}$ and the second excess shaft power $P_{D,h}$, the data analysis means 230 may be arranged to enable selectively estimating the first excess shaft power $P_{D,p}$, the second excess shaft power $P_{D,h}$, or both.

The evaluation means 240 may be arranged to issue an indication concerning propeller cleaning in view of the computed first excess shaft power $P_{D,p}(t_p)$ in case the first excess shaft power $P_{D,p}(t_p)$ has been evaluated by the data analysis means 230. As an example in this regard, the evaluation means 240 may compare the first excess shaft power $P_{D,p}(t_p)$ to a predefined first threshold value and issue the indication, e.g. an alert concerning the need or suggestion for carrying out propeller cleaning, in response to the first excess shaft power $P_{D,p}(t_p)$ exceeding the first threshold value. Instead of directly comparing the first excess shaft power $P_{D,p}(t_p)$ to the first threshold value, the comparison may involve comparing a value derived from the first excess shaft power $P_{D,p}(t_p)$ to the first threshold value. A separate (different) first threshold value may be defined for each of the available reference conditions for the propeller 116. The first threshold value may be defined such that when the first excess shaft power $P_{D,p}(t_p)$ or a value derived therefrom exceeds the first threshold value, the inefficiency of the propeller operation likely incurs, e.g. due to increased fuel consumption, a higher cost than the cost of the propeller cleaning to a condition that matches the respective reference condition of the propeller 116.

As a more detailed example in this regard, an absolute threshold value $Th_{p1}$ may be employed, such that the indication is issued in response to the value of the first excess shaft power $P_{D,p}(t_p)$ exceeding the threshold value $Th_{p1}$, e.g. in response to the condition $P_{D,p}(t_p)>Th_{p1}$ being true. In an example, the threshold value $Th_{p1}$ is a single threshold value that is applicable to all speeds through water $V_s$ of the marine vessel. In another example, a dedicated, different threshold value $Th_{p1}$ is defined for a plurality of speeds through water $V_s$ or for a plurality of sub-ranges of speed through water $V_s$.

As another example, a relative threshold value $Th_{p2}$ may be employed, such that the indication is issued in response to the ratio of the first excess shaft power $P_{D,p}(t_p)$ and the shaft power $P_D(t_s)$ required for the same speed through water $V_s(t_p)$ in the applied reference condition of the propeller 116 exceeding the threshold value $Th_{p2}$, e.g. in response to the condition $$\frac{P_{D,p}(t_p)}{P_D(t_s)} > Th_{p2}$$

being true.

The evaluation means 240 may be arranged to issue an indication concerning hull cleaning in view of the computed second excess shaft power $P_{D,h}(t_h)$ in case the second excess shaft power $P_{D,h}(t_h)$ has been evaluated by the data analysis means 230. As an example in this regard, the evaluation means 240 may compare the second excess shaft power $P_{D,h}(t_h)$ to a predefined second threshold value and issue the indication, e.g. an alert concerning the need or suggestion for carrying out hull cleaning, in response to the second excess shaft power $P_{D,h}(t_h)$ exceeding the second threshold value. Instead of directly comparing the second excess shaft power $P_{D,h}(t_h)$ to the second threshold value, the comparison may involve comparing a value derived from the second excess shaft power $P_{D,h}(t_h)$ to the second threshold value. A separate (different) second threshold value may be defined for each of the available reference conditions for the hull 118. The second threshold value may be defined such that when the second excess shaft power $P_{D,h}(t_h)$ or a value derived therefrom exceeds the second threshold value, the inefficiency of the vessel operation due to hull fouling likely incurs, e.g. due to increased fuel consumption, a higher cost than the cost of the hull cleaning to a condition that matches the respective reference condition of the hull 118.

As a more detailed example in this regard, an absolute threshold value $Th_{h1}$ may be employed, such that the indication is issued in response to the value of the second excess shaft power $P_{D,h}(t_h)$ exceeding the threshold value $Th_{h1}$, e.g. in response to the condition $P_{D,h}(t_h)>Th_{h1}$ being true. In an example, the threshold value $Th_{h1}$ is a single threshold value that is applicable to all speeds through water $V_s$ of the marine vessel. In another example, a dedicated, different threshold value $Th_{h1}$ is defined for a plurality of speeds through water $V_s$ or for a plurality of sub-ranges of speed through water $V_s$.

As another example, a relative threshold value $Th_{h2}$ may be employed, such that the indication is issued in response to the ratio of the second excess shaft power $P_{D,h}(t_h)$ and the shaft power $P_D(t_s)$ required for the same speed through water $V_s(t_h)$ in the applied reference condition for the hull 118 exceeding the threshold value $Th_{h2}$, e.g. in response to the condition $$\frac{P_{D,h}(t_h)}{P_D(t_s)} > Th_{h2}$$

being true.

Instead of or in addition to using the estimated first excess shaft power $P_{D,p}(t_p)$ for issuing the indication as described in the foregoing, this information may be used by the evaluation means 240 to compute or estimate a payback time for the propeller cleaning to a condition that matches the respective reference condition of the propeller 116 applied in the estimation procedure. Similarly, instead of or in addition to using the estimated second excess shaft power $P_{D,h}(t_h)$ for issuing the indication as described in the foregoing, this information may be used by the evaluation means 240 to compute or estimate a payback time for the hull cleaning to a condition that matches the respective reference condition of the hull 118 applied in the estimation procedure. Moreover, a time series of values computed for one or both of the first excess shaft power $P_{D,p}(t_p)$ and the second excess shaft power $P_{D,h}(t_h)$ may be applied to compute a respective trend that indicates the respective excess shaft power as a function of time. Such trend may be employed e.g. to estimate future need for respective aspect of marine fouling for the marine vessel.

The control means 250 may be arranged to control operation of the data acquisition means 210, the data analysis means 230 and the evaluation means 240 to conduct the evaluation of the need for propeller cleaning and/or the evaluation of the need for hull cleaning in a desired manner.

In this regard, the control means 250 may be arranged to issue a first set of commands or requests, including a command or request to the data analysis means 230 to carry out the estimation of the first excess shaft power $P_{D,p}$ and to issue a command or request to the evaluation means 240 to evaluate the need for propeller cleaning at least in dependence of the first excess shaft power $P_{D,p}$. The former command or request may further indicate the time $t_p$ at which the first excess shaft power $P_{D,p}$ is to be estimated. As described in the foregoing, time $t_p$ may denote the current time or a past moment of time.

Moreover, the control means 250 may be arranged to issue a second set of commands or requests, including a command or request to the data analysis means 230 to carry out the estimation of the second excess shaft power $P_{D,h}$ and to issue a command or request to the evaluation means 240 to evaluate the need for hull cleaning at least in dependence of the second excess shaft power $P_{D,h}$. The former command or request may further indicate the time $t_h$ at which the second excess shaft power $P_{D,h}$ is to be estimated. As described in the foregoing, time $t_h$ may denote the current time or a past moment of time.

The control means 250 may be arranged to issue each of the first and second sets commands automatically in accordance with a respective predefined schedule, e.g. at respective regular time intervals. Alternatively or additionally, the control means 250 may be arranged to issue any of the first and second sets of command in response to receiving a user request thereto via a user interface of the diagnostics system 200.

The control means 250 may be further arranged to issue a command or request to the data acquisition means 210 to read respective measurement values from one more sensors 220-*k*. Such a command or request may be automatically invoked e.g. periodically (for example at regular time intervals) and/or in response to the first and/or second set of commands in case the respective set of commands requests evaluation of the first or second excess shaft power $P_{D,p}$ or $P_{D,h}$ for the current time $t_p$ or $t_h$.

Although described in the foregoing with (implicit) references to a single propulsion system, the marine vessel may, alternatively, include two or more propulsion systems like the one outlined in the foregoing. In such a scenario, the data acquisition means 210 may be arranged to obtain measurement values at least for the thrust T generated by the propeller of the propulsion system, for the torque Q in the shaft of the propulsion system and for a rotational speed ω of the shaft of the propulsion system from respective sensors 220 for the two or more propulsion systems. The data analysis means 230 may be arranged to compute respective shaft power $P_D$ for each of the propulsion systems on basis of the torque Q and the rotational speed ω for the respective propulsion system by using the equation (1). Moreover, the data analysis means 230 may be arranged to compute a thrust sum $T_{sum}$ as the sum of the thrusts T from the two or more propulsion systems and to compute a shaft power sum $P_{D,sum}$ as the sum of the shaft powers computed for the two or more propulsion systems. Yet further, the analysis means may be arranged to estimate the first and/or second excess shaft powers $P_{D,p}(t_p)$, $P_{Dhp}(t_h)$ for the two or more propulsion systems as described in the foregoing by using the thrust sum $T_{sum}$ and the shaft power sum $P_{D,sum}$ instead of the thrust T and the shaft power $P_D$ for the single propulsion system.

Figure 4:
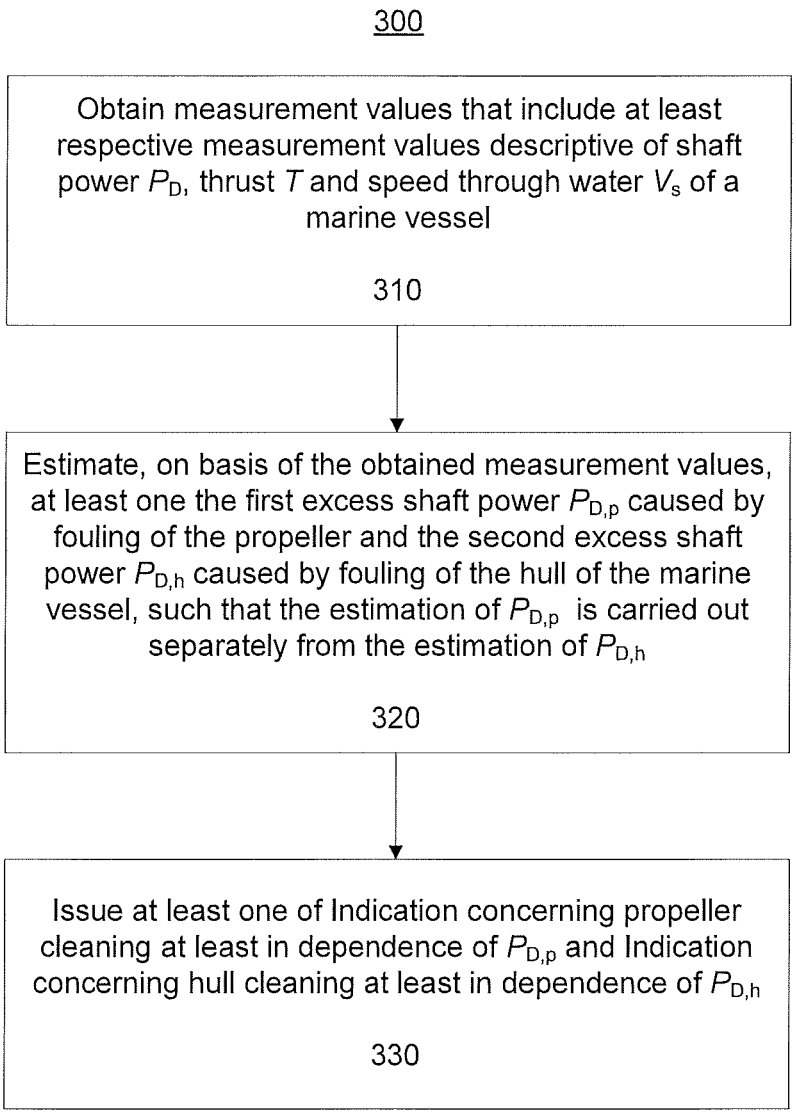
FIG. 4 illustrates a method according to an example embodiment.

FIG. 4 depicts a flowchart that outlines a method 300 according to an example embodiment. The method 300 may implement the diagnostics system 200 described in the examples provided in the foregoing. The method 300 serves to estimate operational efficiency of a marine vessel that employs a propulsion system including a propeller mounted to a rotatable shaft for converting rotative shaft power transferred from the shaft to the propeller into thrust to propel the marine vessel across water.

The method 300 comprises obtaining measurement values that include at least respective measurement values that are descriptive of the shaft power $P_D$, the thrust T and speed through water $V_s$ of the marine vessel, as indicated in block 310. The method 300 further comprises estimating, on basis of the obtained measurement values, at least one the first excess shaft power $P_{D,p}$ caused by fouling of the propeller 116 and the second excess shaft power $P_{D,h}$ caused by fouling of the hull 118 of the marine vessel, wherein the estimation of the first excess shaft power $P_{D,p}$ is carried out separately from the estimation of the second excess shaft power $P_{D,h}$, as indicated in block 320. The method 300 further comprises issuing at least one of an indication concerning propeller cleaning at least in dependence of the first excess shaft power $P_{D,p}$ and an indication concerning hull cleaning at least in dependence of the second excess shaft power $P_{D,h}$, as indicated in block 330. The method 300 outlined herein may be varied in a number of ways, e.g. as described in context of the diagnostics system 200 in the foregoing.

Each of the data acquisition means 210, the data analysis means 230, the evaluation means 240 and the control means 250 may be provided using respective hardware means, respective software means, or respective combination of hardware means and software means. Alternatively, the same piece of hardware means, software means or combination of the hardware and software means may be employed to provide a combination of two or more of the data acquisition means 210, the data analysis means 230, the evaluation means 240 and the control means 250.

Along similar lines, in context of the exemplifying method 300, each of the blocks 310, 320 and 330 may be provided using respective hardware means, respective software means, or respective combination of hardware means and software means, whereas the same piece of hardware means, software means or combination of the hardware and software means may be employed to provide a combination of two or more of blocks 310, 320 and 330.

Figure 5:
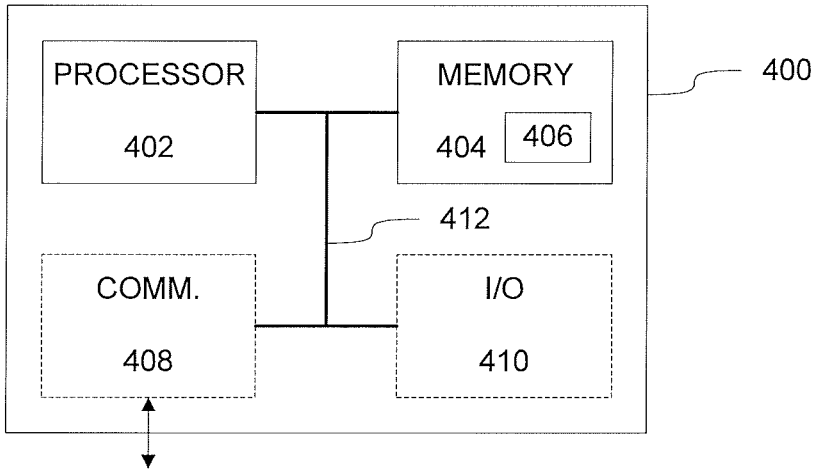
FIG. 5 schematically illustrates some components of an exemplifying apparatus for providing the diagnostics system according to an example embodiment.

As an example of providing the components of the diagnostics system 200 using a combination of hardware means and software means, FIG. 5 schematically illustrates some components of an exemplifying apparatus 400. The apparatus 400 comprises a processor 402 and a memory 404 for storing data and computer program code 406. The memory 404 may comprise or may implement the memory 250 described in the foregoing. The processor 402 is configured to read from and write to the memory 404. The apparatus 400 may further comprise a communication means 408 for communicating with another apparatuses or devices. The communication means 408 may provide interface means for connecting one or more sensors 220-*k* and/or wireless and/or wired communication means that enable communication with other apparatuses using respective communication protocols. The apparatus 400 may further comprise user I/O (input/output) components 410 that may be arranged, together with the processor 402 and a portion of the computer program code 406, to provide a user interface for receiving input from a user and/or providing output to the user. The user I/O components 410 may comprise hardware components such as a display, a touchscreen, a touchpad, a mouse, a keyboard and/or an arrangement of one or more keys or buttons, etc.

The processor 402 may be arranged to control operation of the apparatus 400 in accordance with a portion of the computer program code 406 stored in the memory 404 and possibly further in accordance with the user input received via the user I/O components 410 and/or in accordance with information received via the communication means 408. The memory 404 and a portion of the computer program code 406 stored therein may be further arranged, with the processor 402, to provide a control function or control means for controlling operation of the apparatus 400. The processor 402, the memory 404, the communication means 408 and the user I/O components 410 may be interconnected by a bus 412 that enables transfer of data and control information. The apparatus 400 may comprise further components in addition to those shown in the illustration of FIG. 5.

Although the processor 402 is depicted as a single component, the processor 402 may be implemented as one or more separate processing components. Similarly, although the memory 402 is depicted as a single component, the memory 404 may be implemented as one or more separate components, some or all of which may be integrated/removable and/or may provide permanent/semi-permanent/dynamic/cached storage.

The computer program code 406 stored in the memory 404 may comprise computer-executable instructions that control the operation of the apparatus 400 when loaded into the processor 402. The computer program code 406 may include one or more sequences of one or more instructions. The processor 402 is able to load and execute the computer program code 406 by reading the one or more sequences of one or more instructions included therein from the memory 404. The one or more sequences of one or more instructions may be configured to, when executed by the processor 402, cause the apparatus 400 to carry out operations, procedures and/or functions described in the foregoing in context of the data acquisition means 210, the data analysis means 230, the evaluation means 240 and the control means 250 of the diagnostics system 200 and/or methods steps of blocks 310, 320 and 330 of the method 300. Hence, the apparatus 400 may comprise at least one processor 402 and at least one memory 404 including computer program code 406 for one or more programs, the at least one memory 404 and the computer program code 406 configured to, with the at least one processor 402, cause the apparatus 400 to perform operations, procedures and/or functions described in the foregoing in context of the data acquisition means 210, the data analysis means 230, the evaluation means 240 and the control means 250 of the diagnostics system 200 and/or methods steps of blocks 310, 320 and 330 of the method 300.

The computer program code 406 may be provided e.g. as a computer program product comprising at least one computer-readable non-transitory medium having program code stored thereon, the computer program code 406, when executed by the apparatus 400, arranged to cause the apparatus 400 at least to perform operations, procedures and/or functions described in the foregoing in context of the data acquisition means 210, the data analysis means 230, the evaluation means 240 and the control means 250 of the diagnostics system 200 and/or methods steps of blocks 310, 320 and 330 of the method 300. The computer-readable non-transitory medium may comprise a memory device or a record medium such as a CD-ROM, a DVD, a Blu-ray disc or another article of manufacture that tangibly embodies the computer program. As another example, the computer program may be provided as a signal configured to reliably transfer the computer program.

Reference(s) to a processor should not be understood to encompass only programmable processors, but also dedicated circuits such as field-programmable gate arrays (FPGA), application specific circuits (ASIC), signal processors, etc. Features described in the preceding description may be used in combinations other than the combinations explicitly described.

Features described in the preceding description may be used in combinations other than the combinations explicitly described. Although functions have been described with reference to certain features, those functions may be performable by other features whether described or not. Although features have been described with reference to certain embodiments, those features may also be present in other embodiments whether described or not.

The invention claimed is:

1. A diagnostics system for estimating operational efficiency of a marine vessel that employs a propulsion system including a propeller mounted to a rotatable shaft for converting rotative shaft power transferred from the rotatable shaft to the propeller into thrust to propel the marine vessel across water, the diagnostics system comprising:

a plurality of sensors, each arranged to measure a respective characteristic of marine vessel operation, said sensors including a thrust sensor configured to measure thrust generated by a propeller, a torque sensor configured to measure torque in the rotatable shaft, a rotational speed sensor configured to measure a rotational speed of the rotatable shaft, and a speed sensor configured to measure speed through water of the marine vessel;

at least one processor and at least one memory including computer program code for one or more programs, the at least one memory and the computer program code being configured with the at least one processor to:

obtain measurement values from said plurality of sensors, including measurement values descriptive of shaft power, thrust and speed through water of the marine vessel;

estimate, based on said measurement values, at least one of first excess shaft power caused by fouling of a propeller and second excess shaft power caused by fouling of a hull of the marine vessel, wherein the system is configured to carry out an estimation of the first excess shaft power separately from an estimation of the second excess shaft power, the estimating including at least one of the following:

estimating the first excess shaft power in dependence of shaft power and thrust at a first moment of time in view of the speed through water of the marine vessel at the first moment of time and further in view of shaft power and thrust specified for said speed through water in a first predefined reference condition, and/or estimating the second excess shaft power in dependence of shaft power and thrust at a second moment of time in view of the speed through water of the marine vessel at the second moment of time and further in view of thrust specified for said speed through water in a second predefined reference condition; and issue at least one of an indication concerning propeller cleaning at least in dependence of the first excess shaft power, and an indication concerning hull cleaning at least in dependence of the second excess shaft power, said issuing including:

issuing the indication concerning propeller cleaning in response to the first excess shaft power or a value derived therefrom exceeding a first predefined threshold value, and/or issuing the indication concerning hull cleaning in response to the second excess shaft power or a value derived therefrom exceeding a second predefined threshold value.

2. The diagnostics system according to claim 1, wherein said first and second predefined reference conditions are different conditions, and comprise at least one of the following:

a condition where a propeller is clean; or a condition where a hull of the marine vessel is clean.

3. The diagnostics system according to claim 1, wherein estimating the first excess shaft power comprises:

multiplying the shaft power specified for said speed through water in the first predefined reference condition by a factor that is defined as a ratio of thrust at the first moment of time and the thrust specified for said speed through water in the first predefined reference condition, and subtracting a product so obtained from the shaft power at the first moment of time.

4. The diagnostics system according to claim 3, wherein the first excess shaft power is estimated using an equation:

$$P_{D,p}(t_p) = P_D(t_p) - P_D(t_s)\frac{T(t_p)}{T(t_s)},$$

where $P_{D,p}(t_p)$ denotes the first excess shaft power, $P_D(t_p)$ denotes the shaft power at the first moment of time, $P_D(t_s)$ denotes the shaft power specified for said speed through water in the first predefined reference condition, $T(t_p)$ denotes the thrust at the first moment of time and $T(t_s)$ denotes the thrust specified for said speed through water in the first predefined reference condition.

5. The diagnostics system according to claim 1, wherein estimating of the second excess shaft power comprises:

multiplying the shaft power at the second moment of time by a factor that is defined by subtracting a ratio of the thrust specified for said speed through water in the second predefined reference condition and the thrust at the second moment of time from unity.

6. The diagnostics system according to claim 5, wherein the second excess shaft power is estimated using an equation:

$$P_{D,h}(t_h) = P_D(t_h)\cdot\left(1 - \frac{T(t_s)}{T(t_h)}\right),$$

where $P_{D,h}(t_h)$ denotes the second excess shaft power, $P_D(t_h)$ denotes the shaft power at the second moment of time, $T(t_s)$ denotes the thrust specified for said speed through water in the second predefined reference condition and $T(t_h)$ denotes the thrust at the second moment of time.

7. The diagnostics system according to claim 1, wherein measurement values descriptive of the shaft power include measurement values descriptive of torque in the rotatable shaft and rotational speed of the rotatable shaft; and wherein the shaft power at the first and/or second moment of time is to be estimated by multiplying a torque at a respective moment of time by a rotational speed of the rotatable shaft at the respective moment of time.

8. The diagnostics system according to claim 1, wherein the shaft power and thrust specified for said speed through water in the first or second predefined reference condition are obtained from a reference database stored in a memory, which reference database includes pre-stored reference values for the shaft power and the thrust in the first or second reference condition for a plurality of different speeds through water of the marine vessel.

9. The diagnostics system according to claim 1, wherein said indication concerning propeller cleaning includes an alert or suggestion for carrying out propeller cleaning; and/or wherein said indication concerning hull cleaning includes an alert or suggestion for carrying out hull cleaning.

10. A computer-implemented method for estimating operational efficiency of a marine vessel that employs a propulsion system including a propeller mounted to a rotatable shaft for converting rotative shaft power transferred from the rotatable shaft to the propeller into thrust to propel the marine vessel across water, the method comprising:

obtaining, from a plurality of sensors each arranged to measure a respective characteristic of marine vessel operation, said sensors including a thrust sensor arranged to measure thrust generated by the propeller, a torque sensor arranged to measure torque in rotatable shaft, a rotational speed sensor arranged to measure rotational speed of the rotatable shaft, and a speed sensor arranged to measure speed through water of the marine vessel, measurement values that include at least respective measurement values that are descriptive of the shaft power, the thrust and speed through water of the marine vessel;

estimating, based on said measurement values, at least one of first excess shaft power caused by fouling of the propeller and second excess shaft power caused by fouling of the hull of the marine vessel, wherein an estimation of the first excess shaft power is carried out separately from an estimation of the second excess shaft power, said estimating including:

estimating the first excess shaft power in dependence of the shaft power and thrust at a first moment of time in view of the speed through water of the marine vessel at the first moment of time and further in view of shaft power and thrust specified for said speed through water in a first predefined reference condition, and/or estimating the second excess shaft power in dependence of the shaft power and thrust at a second moment of time in view of the speed through water of the marine vessel at the second moment of time and further in view of thrust specified for said speed through water in a second predefined reference condition, wherein the first and second predefined conditions are a same predefined reference condition or different predefined reference conditions; and issuing at least one of an indication concerning propeller cleaning at least in dependence of the first excess shaft power, and an indication concerning hull cleaning at least in dependence of the second excess shaft power, said issuing including:

issuing the indication concerning propeller cleaning in response to the first excess shaft power or a value derived therefrom exceeding a first predefined threshold value, and/or issuing the indication concerning hull cleaning in response to the second excess shaft power or a value derived therefrom exceeding a second predefined threshold value.

11. The method according to claim 10, wherein said first and second predefined reference conditions are different, and comprise at least one of the following:

a condition where the propeller is clean; and a condition where the hull of the marine vessel is clean.

12. The method according to claim 10, wherein estimating the first excess shaft power comprises:

multiplying the shaft power specified for said speed through water in the first predefined reference condition by a factor that is defined as a ratio of the thrust at the first moment of time and the thrust specified for said speed through water in the first predefined reference condition, and subtracting a product so obtained from the shaft power at the first moment of time.

13. The method according to claim 12, wherein the first excess shaft power is estimated using an equation:

$$P_{D,p}(t_p) = P_D(t_p) - P_D(t_s)\frac{T(t_p)}{T(t_s)},$$

where $P_{D,p}(t_p)$ denotes the first excess shaft power, $P_D(t_p)$ denotes the shaft power at the first moment of time, $P_D(t_s)$ denotes the shaft power specified for said speed through water in the first predefined reference condition, $T(t_p)$ denotes the thrust at the first moment of time and $T(t_s)$ denotes the thrust specified for said speed through water in the first predefined reference condition.

14. The method according to claim 10, wherein estimating the second excess shaft power comprises:

multiplying the shaft power at the second moment of time by a factor that is defined by subtracting a ratio of the thrust specified for said speed through water in the second predefined reference condition and the thrust at the second moment of time from unity.

15. The method according to claim 14, wherein the second excess shaft power is estimated using an equation:

$$P_{D,h}(t_h) = P_D(t_h) \cdot \left(1 - \frac{T(t_s)}{T(t_h)}\right),$$

where $P_{D,h}(t_h)$ denotes the second excess shaft power, $P_D(t_h)$ denotes the shaft power at the second moment of time, $T(t_s)$ denotes the thrust specified for said speed through water in the second predefined reference condition and $T(t_h)$ denotes the thrust at the second moment of time.

16. The method according to claim 10, wherein measurement values descriptive of the shaft power include measurement values descriptive of torque in the rotatable shaft and rotational speed of the rotatable shaft; and wherein the shaft power at the first and/or second moment of time is estimated by multiplying torque at a respective moment of time by the rotational speed of the rotatable shaft at the respective moment of time.

17. The method according to claim 10, wherein the shaft power and thrust specified for said speed through water in the reference condition are obtained from a reference database stored in a memory, which reference database includes pre-stored reference values for the shaft power and the thrust in the first or second predefined reference condition for a plurality of different speeds through water of the marine vessel.

18. The method according to claim 10, wherein said indication concerning propeller cleaning includes an alert or suggestion for carrying out propeller cleaning; and/or wherein said indication concerning hull cleaning includes an alert or suggestion for carrying out hull cleaning.

19. A computer program product comprising:

at least one computer readable non-transitory medium having program code stored thereon, the program being configured such that when executed by a processor will cause the processor at least to perform the method according to claim 10.

* * * * *